United States Patent [19]

Dimond

[11] 4,230,318

[45] Oct. 28, 1980

[54] SHOOTER BOARD GAME

[76] Inventor: Kenneth E. Dimond, 311-615 Colborne St., New Westminster, Canada, V3L 2E1

[21] Appl. No.: 21,969

[22] Filed: Mar. 19, 1979

Related U.S. Application Data

[63] Continuation-in-part of Ser. No. 828,624, Aug. 29, 1977, abandoned.

[51] Int. Cl.[3] ..... A63D 3/02

[52] U.S. Cl. ..... 273/119 R; 124/17; 124/21; 273/129 R

[58] Field of Search ..... 124/23 R, 17, 21, 129 R; 273/118 R, 119 R, 126 R, DIG. 26

[56] References Cited

U.S. PATENT DOCUMENTS

| | | | |
|---|---|---|---|
| 652,056 | 6/1900 | Tait | 273/120 R |
| 952,644 | 3/1910 | Sato | 273/123 R |
| 1,265,761 | 5/1918 | Hardt | 273/126 R |
| 1,537,370 | 5/1923 | Peirce | 273/126 R |
| 1,925,918 | 9/1933 | Cox | 273/119 R |
| 1,943,697 | 1/1934 | Schultz | 273/123 R |
| 3,438,633 | 4/1969 | Thomas | 273/120 R |
| 3,695,247 | 10/1972 | Tucker et al. | 124/17 |

OTHER PUBLICATIONS

"Bugs Bunny Game", Ideal 1976 Catalog, ® in 1976.

*Primary Examiner*—Robert L. Lindsay, Jr.
*Attorney, Agent, or Firm*—Robert D. Farkas

[57] ABSTRACT

A shooter board game includes a board member having an upper planar surface, a pair of upright sides, and one upright end, wherein a target area is disposed on the upper surface adjacent the one upright end thereof. A shooter assembly is positioned off of the board member at the other end thereof, wherein one of a plurality of playing pieces is shot from the shooter assembly at the target area. The shooter assembly is allignable with the marginal edge of the board adjacent the other end to increase the accuracy of aiming the playing pieces. A pair of scoring tracks are included for monitoring the progress of the game by each player.

4 Claims, 4 Drawing Figures

SHOOTER BOARD GAME

BACKGROUND OF THE INVENTION

This Application is a Continuation In Part of prior United States application, Ser. No. 828,624 filed Aug. 29, 1977 now abandoned.

A number of U.S. Patents relate to variously designed shooter type board games but these are non-related to the game of my present invention which has an improved shooter assembly, an improved scoring system, and a set of rules which are unique and novel thereby improving the universal appeal of the game. These U.S. Pat. Nos. are: 1,600,624 to DeBoer; 1,942,280 to Fohmann; 2,083,540 to Armstrong, and 3,865,377 to Cooper, et al.

SUMMARY OF THE INVENTION

One of the problems of apartment living is that the choice of entertaining games is limited to the "sit down" type of games such as checkers, chess, cards, etc. Recreation room games such as billiards, pool, shuffleboard and others are too large or too noisy or awkward to set up in apartments and this is unfortunate as many people like to play these more active games.

An object of the present invention is to provide a recreation room type of game for apartments that would make apartment living more agreeable and at the same time be easy to put away, quiet to play and universally appealing to most age groups.

A further object of my invention is to provide a shooter board game having an improved scoring system.

A further object of my present invention is to provide a shooter board game having an improved shooter assembly, allignable with the playing board, if desired, or useful at a remote distance therefrom.

Briefly, my present invention comprises a board member having an upper planar surface, a pair of sides, and a pair of ends, one of which has an upright tail or sides. A target area is disposed on the upper surface at one end thereof adjacent the upright side or flange. A shooter assembly is positioned off of the other end of the board member, wherein one of a plurality of playing pieces is shot from the shooter assembly at the target area. A pair of scoring tracks are provided for mounting the progress of the game by each player.

BRIEF DESCRIPTION OF THE DRAWINGS

The objects and features of the invention may be understood with reference to the following detailed description of an illustrative embodiment of the invention, taken together with the accompanying drawings, in which.

DESCRIPTION OF THE PREFERRED EMBODIMENT

Figure 1:
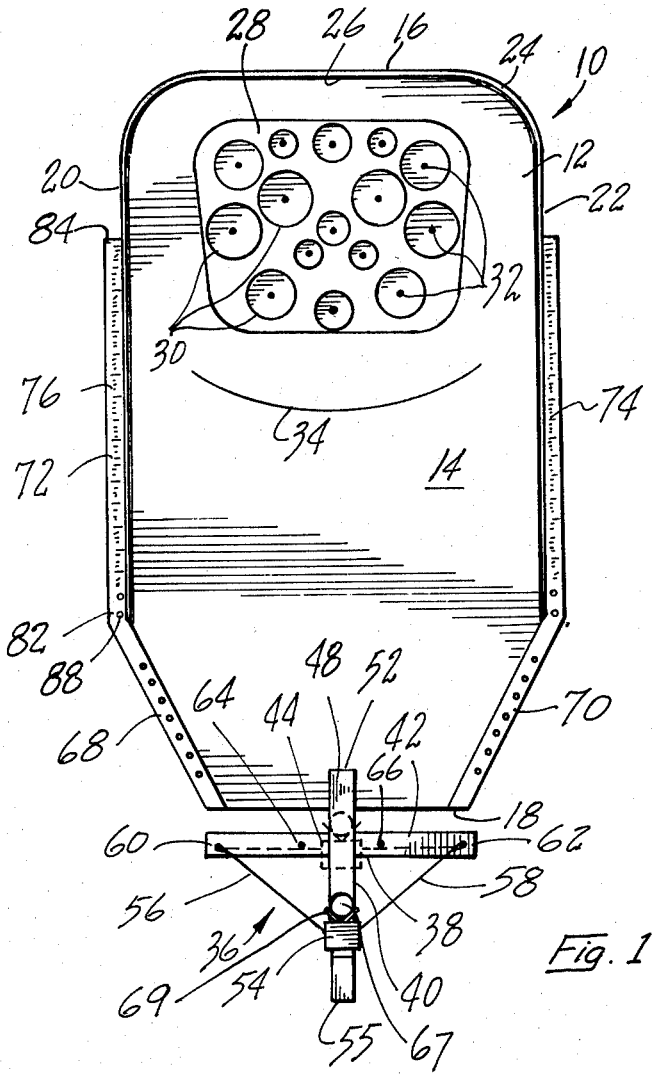
FIG. 1 illustrates a top planar view of a shooter board game.
Figure 2:
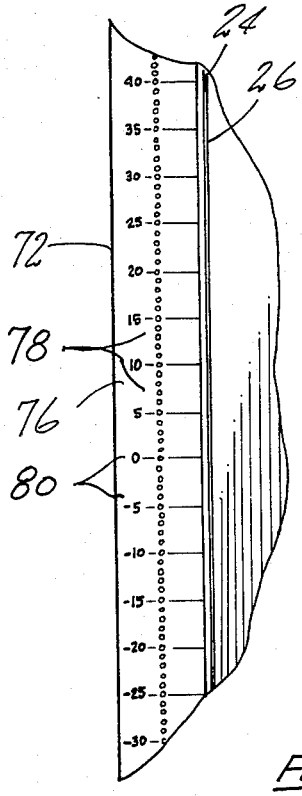
FIG. 2 illustrates an enlarged top planar view of one of two scoring tracks of the game.
Figure 3:
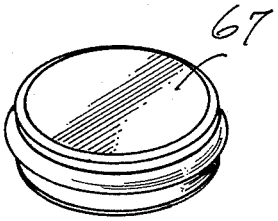
FIG. 3 illustrates a perspective view of a playing piece of the game.
Figure 4:
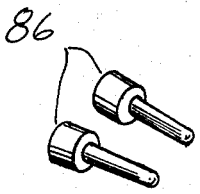
FIG. 4 illustrates a perspective view of two scoring pages of the game.

Turning now descriptively to the drawings, in which similar reference characters denote similar elements throughout the several views, FIG. 1 shows a board game 10 which includes a board member 12 having a planar upper surface 14, a pair of ends 16, 18 and a pair of sides 20, 22 wherein the sides 20, 22 taper inwardly at an acute angle near end 18 such that rear end 18 is shorter than front end 16. An upwardly extending flange 24 is secured perpendicularly secured to end 16 and sides 20, 22, wherein the inner surface of flange 24 has a rubberized coating 26 disposed thereon. A geometrically shaped target area 28 is disposed on upper surface 14 at end 16, wherein a plurality of circular shaped indicia 30 are disposed within area 28. Indicia point values 30 are numbered from two to six. A pin element 32 is disposed at the center of each indicia 30 and extends perpendicularly upwardly from the upper surface 14. A concaved penalty line 34, as aligned towards front end 18, is disposed transversely on upper surface 14 between area 28 and rear end 18. A shooter assembly 36 is positioned off of board member 12 at rear end 18 thereof. The shooter assembly comprises a cross-shaped member 38 having an ejector guide arm 40 and a cross arm 42 which is disposed under ejector guide 40. The cross arm 42 at its juncture with stem 40, is spaced apart therefrom by a spacer 44. The upper surface 48 of the ejector guide 40 extends from the front end 52 to the rear end 55 of guide 40. A block member 54, used as an ejector, is slidably disposed on upper surface 48 on ejector guide 40 wherein a V shaped element 69 is disposed on the surface of block 54. A pair of elastic band members 56, 58 are joined to the block member 54, wherein one of the band members 56, 58 is joined to each side of block 54. The free ends of each band members 56, 58 are anchored by staple means to teach end 60,62 of the cross bar 42. A pair of stop members 64, 66 are perpendicularly on the upper surface of cross bar 42, wherein one member 64 is disposed on one side of juncture 44 and the other member 66 is disposed on the other side of juncture 44. A plurality of playing pieces 67 are provided as shown in FIGS. 1, 3 which are shot by shooter assembly 36 at target area 30. There are two sets of seven playing pieces 67 provided, wherein one set is color coded by a first color and the second set is color coded by a second color. At the paper portion of each side 20,22 are affixed tray elements 68, 70, wherein the tray elements 68, 70 extend linearly outwardly from sides 20, 22. Tray element 68 holds one set of playing pieces 67 thereon and tray element 70 holds the other set of playing pieces 67 thereon. A pair of score tracks 72, 74 are provided, wherein tracks are affixed to and extend linearly outwardly from the longitudinally aligned portions of sides 20,22 wherein each track 72, 74 is an elongated bar member 76 having a plurality of longitudinally aligned apertures 78 in its upper surface as shown in FIGS. 1, 2. These are 150 apertures 78 in each bar member 76, wherein each aperture 76 is assigned a numeral indicia 80 of from minus fifty to plus one hundred such that the minus aperture 78 is disposed at the rear end 82 of bar member 76 and the plus one hundred aperture 78 is disposed at the front end 84 of bar member 76. FIG. 4 shows a pair of peg members 86 which are removably received into the apertures 78 of each track 72, 74 for indicating the scoring progress of the game 10. There are provided four black pegs, two yellow pegs, and one white peg. One yellow peg 86 is inserted into the zero aperture 78 of each track. The black pegs 86 are inserted into the minus fifty and plus one hundred apertures 76 of the two tracks 72, 74. A starter hole 88 is disposed in the upper surface of each bar member 78 at the rear end 82 thereof, wherein the white peg 86 is used in the score track.

The player places a playing piece 67 on upper surface 48 of stem 48 and pulls back block 54 with piece 67 positioned in element 69 as he pushes downwardly on near end 54 of stem 40 causing the playing piece 67 to slide rearwardly on guide 40 against block 54. The stem 40 is rotated left or right and then stem 40 is aligned horizontally. The block 54 is released causing piece 67 to be shot forwardly. The elastic band members 56, 58 are stopped by stop members 64, 66.

The adjacent side of cross arm 42 may be located in touching engagement with end 18 of board member 12. Alternatively, the entire shooter assembly 36 may be displaced away from touching engagement with board member 12. Obviously, when the shooter assembly 36 is aligned by engaging the board 12 open end, at edge 18, the alignment of cross arm 42 is assured. Stop members 64 and 66 are aligned axially with the edge of cross arm 42 that engages edge 18 of board member 12, thereby permitting block 54, when released to travel perpendicularly to edge 18. This enhances the ability of the player to ensure that band members 56, 58 are contacting stop members 64 and 66 when the stop members are parallel to edge 18. Further, block 54 is fitted to arm 40 loosely, such as by utilizing an oversized notch in the lower surface of block 54, larger than the width of arm 40. In this manner, a twisting force can be applied to Block 54 just before it is released, thereby setting up a built in turning motion to projectile or playing piece 67 on its release. Engagement of cross arm 42 to open edge 18, being a straight line, not only aligns cross arm 40 in a preferred direction of travel, but allows the shooter assembly to be positioned closer to board member 12. Straight edge 18 and straight edge of arm 42 provide a visual alignment area for the shooting player, thereby enhancing the ability to set up a twisting force on projectile 67, as described, for those instances that the shooter assembly is positioned away from touching engagement with board member 12.

The game is played as follows, wherein the objective of the game is to score enough points such that the yellow peg 86 of one player exceeds the upper desired point value as indicated by a black peg 86 or the yellow peg 86 of a second player diminishes below the minus point value as indicated by black peg 86. The game is divided into ends, wherein each end includes six turns by each player. For the first end the block pegs are set at −50 and +100; for the second end at −40 and +90, for the third end at −30 and +80, and so forth. Player continues until one of the players exceeds the positive point value or falls below the negative point value.

A typical end is played in the sequence as follows:

(1) The first player shoots his seven men, trying to put them on the target area.

(2) After shooting his seven men he is penalized seven points for each of his men left outside the target area. This is done by moving his scorepeg (yellow) backwards the required number of holes.

(3) Then he (first player) takes five of his men off the board, leaving the two most strategically placed men and places the five he has removed on his tray.

(4) Now the second player shoots his men (seven), trying to move one or both of the first player's men out of the target area, at the same time trying to keep his own men in.

(5) After shooting his seven men he is penalized seven points for each of his men left outside the target area.

(6) He (second player) then removes five of his own men and places them in his tray. He leaves two of his men in the target area. This finishes the seven set, so called because each player uses seven men. Now each player has five men left to shoot and so the next set is the five set.

(7) The first player now shoots his remaining five men.

(8) After he shoots them he is penalized five points for each of his men left outside the target area.

(9) Then he removes four of his men from the board.

(10) The second player now shoots his five men.

(11) After he does he is penalized for each of his men left outside the target area.

(12) He removes four of his men from the board.

This finishes the five set. Each player now has four men left to shoot and so the next set is the four set.

(13) The first player shoots his four men.

(14) He is penalized four points for each of his men left outside the target area after he finishes shooting.

(15) He removes three of his men.

(16) The second player repeats (13), (14), and (15).

This finishes the four set. Each player has three men left and so the next set is the three set.

(17) The first player shoots his three men.

(18) He is penalized three points for each of his men left outside the target area after he finishes shooting.

(19) He removes two of his men.

(20) The second player repeats (17), (18), and (19).

This finishes the three set. Each player has two men left and so the next set is the two set.

(21) The first player shoots his two men.

(22) He is penalized two points for each of his men left outside the target area after he finishes shooting.

(23) He removes one of his men.

(24) The second player repeats (21), (22), and (23).

This finishes the two set. Each player has one man left and so the next set is the one set.

(25) The first player shoots his one man.

(26) The second player shoots his one man.

(27) The first player is penalized five points for any men left out of the target area.

(28) The second player is penalized five points for any men left out of the target area.

(29) The players receive plus points for each piece 67 landing in an indicia 30 that remain on the conclusion of each end.

(30) At the finish of the end, the next end is started by movement of the black pegs 86.

(31) If a player allows the shooter to engage the board, as by allowing the aligning edge of the cross arm to engage the straight edge at the open ends of the board, he is penalized a number of points agreed upon by the players in advance of each use of the shooter assembly, when so aligned.

Since obvious changes may be made in the specific embodiment of the invention described herein, such modifications being within the spirit and scope of the invention claimed, it is indicated that all matter contained herein is intended as illustrative and not as limiting in scope.

Having this described the invention, what I claim as new and desire to secure by Letters Patent of the United States is:

1. A shooter board game, which comprises:

a. a board member having an upper planar playing surface, a pair of sides, and a pair of ends, and flange members secured to said pair of sides and one of said pair of ends extending upwardly from said planar surface, the other side of said pair of ends extending along a straight line;

b. a target area disposed on said upper surface of said board member adjacent said one end thereof;

c. a shooter assembly selectively positionable away from touching engagement with said board member and in touching engagement with said board member at said other of said pair of ends, said shooter assembly including a cross-shaped element, said cross-shaped element having a first elongated arm, a second elongated arm, said second arm joined to a lower surface of said first arm, said first arm having a straight marginal edge, a block member slidably disposed on said first arm, wherein said one of said playing pieces is projectable intermediate said flange members disposed at said pair of sides of said planar surface and towards a portion of said flange members disposed at said one of said pair of ends of said planar surface where said straight marginal edge is selectively located adjacent to said other of said pairs of ends, and a V-shaped element disposed on a surface of said block member, said one of said playing pieces being disposed within said V-shaped element, and a first elastic band member communicating between one said block and one end of said second arm, and a second elastic bank member communicating between said block and another end of said second arm, and a pair of stop members extending upwardly from said second arm, said pair of stop members being aligned parallel to said straight edge, said stop members engaging said elastic bands thereby restricting forward motion of said block member;

d. two sets of a plurality of disc shaped playing pieces, one of said playing pieces at a time removably received onto said shooter assembly to be forwarded projected across said upper surface towards said target area;

e. two scoring tracks, each said track including an elongated bar member having a plurality of longitudinally aligned apertures disposed in its upper surface, said apertures being numbered from a minus numerical indicia at one end to a positive numerical indicia at another end of said bar each of said two scoring tracks located at said flange members disposed at said pair of sides of said planar surface;

f. four first colored pegs, two of set pegs removably received in said end apertures of each said track; and g. two second colored pegs, one of said second pegs removably received in said apertures of each of said bars between said first colored pegs.

2. A game according to claim 1, further including a plurality of geometrically shaped indicia disposed within said target area, each said geometrically shaped indicia being assigned a point value.

3. A game according to claim 1, further comprising a pair of tray elements affixed to said sides of said board, each said tray element removably receiving one of said sets of said playing pieces therein.

4. A game according to claim 1, further including a penalty line disposed on said upper surface between said target area and said other end of said board member.

* * * * *